United States Patent [19]

Johanson

[11] Patent Number: 4,757,757

[45] Date of Patent: Jul. 19, 1988

[54] COMPACTION OF GRANULAR SOLIDS WITH A COMBINATION OF SHEAR AND DIRECT COMPRESSION

[75] Inventor: Jerry R. Johanson, San Luis Obispo, Calif.

[73] Assignee: JR Johanson, Inc., San Luis Obispo, Calif.

[21] Appl. No.: 922,051

[22] Filed: Oct. 21, 1986

[51] Int. Cl.[4] ..... B30B 7/02; B30B 7/04

[52] U.S. Cl. ..... 100/41; 100/72; 100/179; 100/244; 100/264; 100/215; 53/530

[58] Field of Search ..... 53/530, 179; 100/909, 100/221, 229 A, 244, 264, 70 R, 71, 41, 72, 137, 141, 142, 215, 216

[56] References Cited

U.S. PATENT DOCUMENTS

| | | | |
|---|---|---|---|
| 3,070,003 | 12/1962 | Stacy | 100/244 X |
| 3,501,890 | 3/1970 | Hunt | 100/41 |
| 3,621,775 | 11/1971 | Dedio et al. | 100/179 X |
| 3,802,337 | 4/1974 | St. Hiliare | 100/179 X |
| 3,827,213 | 8/1974 | Matzinger | 53/530 X |
| 3,854,397 | 12/1974 | Dempster | 100/179 X |
| 3,956,981 | 5/1976 | Pitt | 100/41 X |
| 4,073,229 | 2/1978 | O'Rourke et al. | 100/229 A |
| 4,102,109 | 7/1978 | Modra et al. | 100/229 A |

FOREIGN PATENT DOCUMENTS

| | | | |
|---|---|---|---|
| 491581 | 11/1936 | United Kingdom | 100/244 |

*Primary Examiner*—Andrew M. Falik

*Attorney, Agent, or Firm*—Daniel C. McKown

[57] ABSTRACT

A first body has a cylindrical section that is adjacent a conical section so as to form a constricted passage through which granular solids are forced under pressure. Passage through the constriction results in the application of shear forces to the granular solids which degrades some of the particles to create fines to fit between the larger particles and which induces interparticle motion that facilitates the compaction process. After passing through the constriction, the compacted solids are received in a cylindrical receiving chamber, into which a piston can be inserted for the application of direct compression forces. In a preferred embodiment, the granular solids are forced through several constricted passages in sucession, resulting in several stages of compaction prior to the final stage of direct compression.

14 Claims, 1 Drawing Sheet

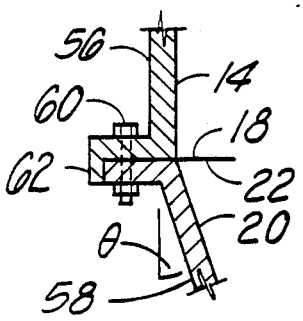
FIG. 1a
FIG. 1
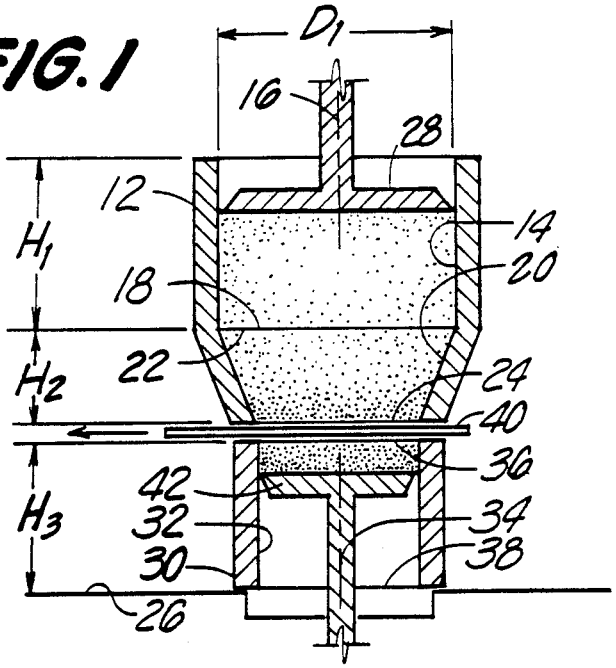
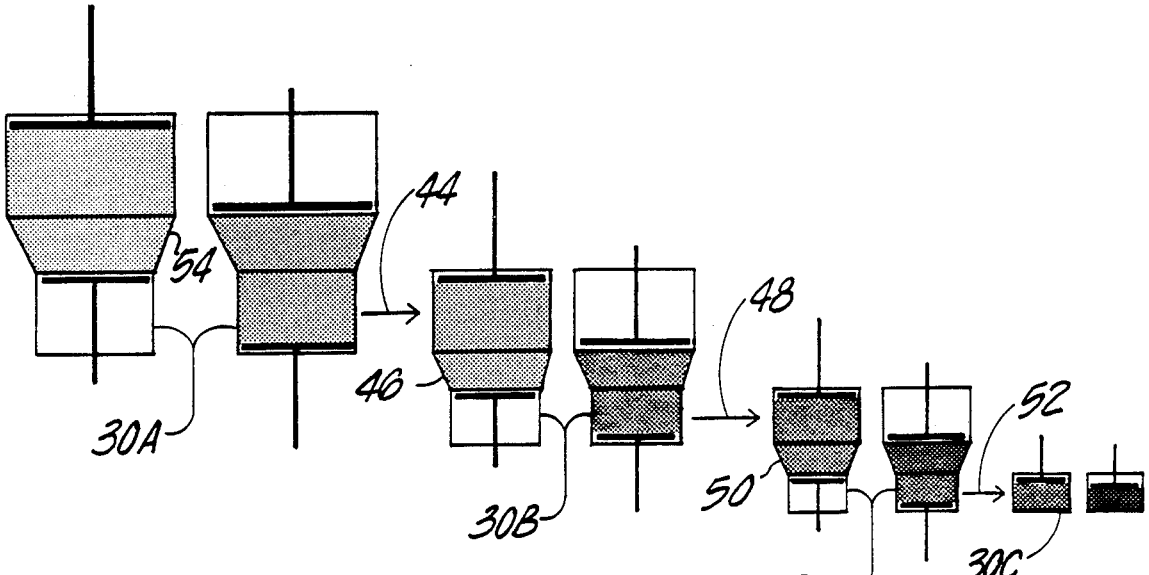
FIG. 2

COMPACTION OF GRANULAR SOLIDS WITH A COMBINATION OF SHEAR AND DIRECT COMPRESSION

BACKGROUND OF THE INVENTION

Field of the Invention

The present invention is in the general field of the mechanical processing of granular solids, and more specifically is concerned with an apparatus and a method for compacting granular solids through the application of both shear and direct compression forces.

Bulk granular solids are normally composed of particles of various irregular shapes and sizes. The compaction of such a heterogeneous mixture generally requires not only the rearrangement of particles, but the degrading of some of the particles to create fines to fit between the larger particles.

This degrading and rearrangement is most easily accomplished when the compaction process and apparatus encourages interparticle motion. Unfortunately, the application of the large solids contact stress usually necessary for compaction is most easily accomplished by direct compression without inducing interparticle motion.

In direct compression, the bulk granular solid is typically placed in a closed cylinder, and a force is applied to the material by means of a piston. The material is subjected only to a unidirectional compressive force, and this results in the creation of relatively few fines, and does not result in as great a degree of rearrangement as might be desired.

SUMMARY OF THE INVENTION

The present invention provides a two (or more) stage compaction apparatus and method that first induces interparticle motion to rearrange and degrade the material; then, without allowing a rearrangement of the particles, the method provides a final stage of direct high-pressure compaction.

In accordance with the present invention, the bulk particulate matter is forced to flow through one or more tapered converging passages which not only compress the material but also produce shear forces and the rearrangement of the particles. The compact thus produced is then subjected to a direct compression which further compacts the material.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 1 is a side elevational view in cross section showing a preferred embodiment of the apparatus of the present invention;

FIG. 1*a* is a fractional side elevational view in cross section showing an alternative construction of the apparatus; and, FIG. 2 is a diagram showing the use of the apparatus in a multi-stage process.

DETAILED DESCRIPTION OF THE PREFERRED EMBODIMENT

FIG. 1 is a side elevational view in cross section showing an apparatus in accordance with the preferred embodiment. The apparatus includes a first body 12 and a second body 30. Normally, the first body 12 is supported a fixed distance above the floor 26 and the second body 30 rests on the floor 26 with its axis 34 coinciding with the axis 16 of the first body 12. A slide gate 40 is shown interposed between the first body 12 and the second body 30 in FIG. 1. However, during the compaction process, the slide gate 40 is withdrawn laterally as indicated by the arrow in FIG. 1.

The first body 12 includes a cylindrical interior surface 14 whose axis is vertical and which extends from the top of the first body to a lower edge 18. The interior surface of the first body 12 further includes the conical surface 20 whose upper edge 22 coincides with the lower edge 18 of the cylindrical surface and which converges downwardly to a lower edge 24. Together, the cylindrical surface 14 and the conical surface 20 form a constricted passage for the granular solids, which causes the granular solids to be subjected to deformation in a direction perpendicular to the direction of flow. A piston 28, which fits in the space bounded by the cylindrical surface 14 with a loose sliding fit, is provided to permit pressure to be applied in a downward direction to the granular solids.

The second body 30, which could also be called the receiving chamber, includes an approximately cylindrical interior surface 32 having a vertical axis 34 that coincides with the vertical axis 16 of the first body 12. In FIG. 1, the thickness of the slide gate 40 and the separation between the first body 12 and the second body 30 are exaggerated for clarity of illustration, but in reality, the gap between the first body 12 and the second body 30 is much smaller than shown in FIG. 1. An upwardly-biased piston 42 fits within the space bounded by the cylindrical interior surface 32 and is used for applying an upwardly directed force to maintain a pressure against the granular material. In the preferred embodiment, the surface 32 diverges downwardly from its upper edge 36 to its lower edge 38, departing from true vertical by approximately 0.25 degrees.

In the preferred embodiment, the fill height $H_1 \leqq D_1$. The cone angle $\theta$ is less than the critical angle that must not be exceeded if downward flow is to be maintained at the walls of the conical surface 20. This insures that dead (non-flowing) regions will not exist along the conical surface 20. In the preferred embodiment, $\theta < 20$ degrees is suitable for most granular solids. The height $H_2$ of the conical surface 20 must be short enough to maintain a reasonable force transition between piston 28 and piston 42. This generally requires $H_2 < 0.3\ D_1$. The volume enclosed by the cylindrical surface 32 should be large enough to accommodate the granular solids that occupied the volume enclosed by the cylindrical surface 14 before they were compacted.

In operation, initially the piston 42 is elevated to the upper edge 36 of the second body 30, the piston 28 is withdrawn from the first body 12, the slide gate 40 is withdrawn, and the granular material is introduced into the space within the first body 12. Thereafter, the piston 28 is lowered into the first body 12 and a force is applied to the piston 28, which causes the granular material to move past the lower edge 24 of the conical surface 20, which motion is yieldingly opposed by the piston 42. The value of the initial pressure can be about half the final load for compaction and still apply about the same major principal compression stress to the solids during lateral compaction as during direct compaction. The compaction process continues until the piston 28 has been lowered to the lower edge 18 of the cylindrical surface 14 or until the volume within the second body 30 has been completely filled, whichever occurs first.

At that point, the slide gate 40 is interposed between the first body 12 and the second body 30 to prevent the granular solids from flowing downwardly from within the first body 12. The piston 42 is retracted from within the second body 30, and in a preferred embodiment, the piston 42 retracts into a recessed area in the floor 26. Thereafter, the second body is moved laterally to a different station, at which a piston is inserted in the top of the second body for the purpose of applying a direct compression force to the granular material inside the second body, in the manner described above.

It should be noted, that the first body remains filled to approximately the lower edge 18 of the cylindrical surface 14 with granular material, and the portion of that material near the lower end of the first body is already somewhat compacted.

After the compacted material has been removed from the second body 30 at the second station, the second body 30 is returned to its position beneath the first body 12. Next, the piston 42 is elevated to the upper edge 36 of the second body 30, the piston 28 is withdrawn from the first body, and a new charge of granular material is added to the space within the first body 12. Thereafter, the piston 28 is brought to bear on the material, and the compaction process begins anew.

FIG. 1*a* shows an alternative construction of the first body 12 of FIG. 1 in which the first body consists of a cylindrical part 56 and a conical part 58 which are fastened together by bolts 60. The rim 62 facilitates registration.

FIG. 2 is a diagram that illustrates the possibility of employing three stages of lateral compaction prior to a final stage in which a direct compression is used. The receiving chamber 30A used in the first stage is shifted laterally as indicated by the arrow 44 and is positioned on top of a conical section 46, which, in turn, is positioned on top of the receiving chamber 30B of the second stage. After the second stage compaction, the receiving chamber 30B is shifted laterally, as indicated by the arrow 48, and is then positioned on top of a conical section 50, which in turn is seated on top of the third stage receiving chamber 30C. After the third stage of compaction has been carried out, the receiving chamber 30C is moved laterally, as indicated by the arrow 52, and a direct compressive force is then applied as the final stage of the process. Note that the conical sections of each of the stages remain filled with partially compacted material, so that the entire process is semi-continuous. Also, note that after the cylindrical receiving chamber 30A has been emptied at the completion of the second stage of compaction, that cylindrical body may then be repositioned beneath the conical section 54 used in the first compaction stage.

Thus, there has been described an apparatus and a method for the compaction of granular solids through the use of a combination of shear and direct compression forces.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. Apparatus for use in compacting granular solids by the combined application of shear and direct compression, comprising:

a first body, hollow, and having interior surfaces bounding a space within said first body, said interior surfaces including a cylindrical surface having a vertical axis and having a lower edge, and a conical surface, coaxial with said cylindrical surface, having an upper edge that coincides with the lower edge of said cylindrical surface, and converging downwardly to a lower edge;

a second body, hollow, and having an approximately cylindrical interior surface bounding a space within said second body, said approximately cylindrical interior surface having a vertical axis colinear with the vertical axis of the cylindrical surface of said first body, said second body situated below said first body, said approximately cylindrical interior surface of said second body having an upper edge whose diameter approximately equals the diameter of the lower edge of the conical surface of said first body; and, a slide gate removably interposed between said first body and said second body and selectively removable in a lateral direction.

2. Apparatus for use in compacting granular solids by the combined application of shear and direct compression, comprising:

a first body, hollow, and having interior surfaces bounding a space within said first body, said interior surfaces including a cylindrical surface having a vertical axis and having a lower edge, and a conical surface, coaxial with said cylindrical surface, having an upper edge that coincides with the lower edge of said cylindrical surface, and converging downwardly to a lower edge, the conical surface of said first body being inclined to vertical by an angle $\theta$ that is less than a critical angle that must not be exceeded if downward flow of granular solids along the conical surface of said first body is to be maintained; and, a second body, hollow, and having an approximately cylindrical interior surface bounding a space within said second body, said approximately cylindrical interior surface having a vertical axis colinear with the vertical axis of the cylindrical surface of said first body, said second body situated below said first body, said approximately cylindrical interior surface of said second body having an upper edge whose diameter approximately equals the diameter of the lower edge of the conical surface of said first body.

3. Apparatus for use in compacting granular solids by the combined application of shear and direct compression, comprising:

a first body, hollow, and having interior surfaces bounding a space within said first body, said interior surfaces including a cylindrical surface having a vertical axis and having a lower edge, and a conical surface, coaxial with said cylindrical surface, having an upper edge that coincides with the lower edge of said cylindrical surface, and converging downwardly to a lower edge, the height of the conical surface of said first body being less than 0.3 times the diameter of the conical surface at its upper edge; and, a second body, hollow, and having an approximately cylindrical interior surface bounding a space within said second body, said approximately cylindrical interior surface having a vertical axis colinear with the vertical axis of the cylindrical surface of said first body, said second body situated below said first body, said approximately cylindrical interior surface of said second body having an upper edge whose diameter approximately equals the diameter of the lower edge of the conical surface of said first body.

4. Apparatus for use in compacting granular solids by the combined application of shear and direct compression, comprising:

a first body, hollow, and having interior surfaces bounding a space within said first body, said interior surface including a cylindrical surface having a vertical axis and having a lower edge, and a conical surface, coaxial with said cylindrical surface, having an upper edge that coincides with the lower edge of said cylindrical surface, and converging downwardly to a lower edge; and, a second body, hollow, and having an approximately cylindrical interior surface bounding a space within said second body, said approximately cylindrical interior surface having a vertical axis colinear with the vertical axis of the cylindrical surface of said first body, said second body situated below said first body, said approximately cylindrical interior surface of said second body having an upper edge whose diameter approximately equals the diameter of the lower edge of the conical surface of said first body, and wherein said approximately cylindrical interior surface of said second body diverges slightly from its upper edge to its lower edge.

5. Apparatus for use in compacting granular solids by the combined application of shear and direct compression, comprising:

a first body, hollow, and having interior surfaces bounding a space within said first body, said interior surfaces including a cylindrical surface having a vertical axis and having a lower edge, and a conical surface, coaxial with said cylindrical surface, having an upper edge that coincides with the lower edge of said cylindrical surface, and converging downwardly to a lower edge;

a second body, hollow, and having an approximately cylindrical interior surface bounding a space within said second body, said approximately cylindrical interior surface having a vertical axis colinear with the vertical axis of the cylindrical surface of said first body, said second body situated below said first body, said approximately cylindrical interior surface of said second body having an upper edge whose diameter approximately equals the diameter of the lower edge of the conical surface of said first body; and, an upwardly-biased piston movable axially within the space bounded by the approximately cylindrical interior surface of said second body.

6. Apparatus for use in compacting granular solids by the combined application of shear and direct compression, comprising:

a first body, hollow, and including a cylindrical interior surface having a vertical axis and a lower edge;

a second body, hollow, located below said first body and including a conical interior surface, coaxial with the cylindrical interior surface of said first body, having an upper edge that coincides with the lower edge of the cylindrical interior surface of said first body, and converging downwardly to a lower edge;

a third body, hollow, located below said second body, and including an approximately cylindrical interior surface having a vertical axis colinear with the vertical axis of the cylindrical interior surface of said first body, the approximately cylindrical interior surface of said third body having an upper edge whose diameter approximately equals the diameter of the lower edge of the conical surface of said second body and that is located adjacent the lower edge of the conical surface of said second body; and, a slide gate removably interposed between said second body and said third body and selectively removable in a lateral direction.

7. Apparatus for use in compacting granular solids by the combined application of shear and direct compression, comprising:

a first body, hollow, and including a cylindrical interior surface having a vertical axis and a lower edge;

a second body, hollow, located below said first body and including a conical interior surface, coaxial with the cylindrical interior surface of said first body, having an upper edge that coincides with the lower edge of the cylindrical interior surface of said first body, and converging downwardly to a lower edge, the conical surface of said second body being inclined to vertical by an angle $\theta$ that is less than a critical angle that must not be exceeded if downward flow of granular solids along the conical surfaces of said second body is to be maintained; and, a third body, hollow, located below said second body, and including an approximately cylndrical interior surface having a vertical axis colinear with the vertical axis of the cylindrical interior surface of said first body, the approximately cylindrical interior surface of said third body having an upper edge whose diameter approximately equals the diameter of the lower edge of the conical surface of said second body and that is located adjacent the lower edge of the conical surface of said second body.

8. Apparatus for use in compacting granular solids by the combined application of shear and direct compression, comprising:

a first body, hollow, and including a cylindrical interior surface having a vertical axis and a lower edge;

a second body, hollow, located below said first body and including a conical interior surface, coaxial with the cylindrical interior surface of said first body, having an upper edge that coincides with the lower edge of the cylindrical interior surface of said first body, and converging downwardly to a lower edge, the height of the conical surface of said second body being less than 0.3 times the diameter of the conical surface at its upper edge; and, a third body, hollow, located below said second body, and including an approximately cylindrical interior surface having a vertical axis colinear with the vertical axis of the cylindrical interior surface of said first body, the approximately cylindrical interior surface of said third body having an upper edge whose diameter approximately equals the diameter of the lower edge of the conical surface of said second body and that is located adjacent the lower edge of the conical surface of said second body.

9. Apparatus for use in compacting granular solids by the combined application of shear and direct compression, comprising:

a first body, hollow, and including a cylindrical interior surface having a vertical axis and a lower edge;

a second body, hollow, located below said first body and including a conical interior surface, coaxial with the cylindrical interior surface of said first body, having an upper edge that coincides with the lower edge of the cylindrical interior surface of said first body, and converging downwardly to a lower edge; and, a third body, hollow, located below said second body, and including an approximately cylindrical interior surface having a vertical axis colinear with the vertical axis of the cylindrical interior surface of said first body, the approximately cylindrical interior surface of said third body having an upper edge whose diameter approximately equals the diameter of the lower edge of the conical surface of said second body and that is located adjacent the lower edge of the conical surface of said second body, and wherein said approximately cylindrical interior surface of said third body diverges slightly from its upper edge to its lower edge.

10. Apparatus for use in compacting granular solids by the combined application of shear and direct compression, comprising:

a first body, hollow, and including a cylindrical interior surface having a vertical axis and a lower edge;

a second body, hollow, located below said first body and including a conical interior surface, coaxial with the cylindrical interior surface of said first body, having an upper edge that coincides with the lower edge of the cylindrical interior surface of said first body, and converging downwardly to a lower edge;

means for selectively fastening said first body to said second body; and, a third body, hollow, located below said second body, and including an approximately cylindrical interior surface having a vertical axis colinear with the vertical axis of the cylindrical interior surface of said first body, the approximately cylindrical interior surface of said third body having an upper edge whose diameter approximately equals the diameter of the lower edge of the conical surface of said second body and that is located adjacent the lower edge of the conical surface of said second body.

11. Apparatus for use in compacting granular solids by the combined application of shear and direct compression, comprising:

a first body, hollow, and including a cylindrical interior surface having a vertical axis and a lower edge;

a second body, hollow, located below said first body and including a conical interior surface, coaxial with the cylindrical interior surface of said first body, having an upper edge that coincides with the lower edge of the cylindrical interior surface of said first body, and converging downwardly to a lower edge;

a third body, hollow, located below said second body, and including an approximately cylindrical interior surface having a vertical axis colinear with the vertical axis of the cylindrical interior surface of said first body, the approximately cylindrical interior surface of said third body having an upper edge whose diameter approximately equals the diameter of the lower edge of the conical surface of said second body and that is located adjacent the lower edge of the conical surface of said second body; and, an upwardly-biased piston movable axially within the space bounded by the approximately cylindrical interior surface of said third body.

12. A process for compacting granular solids by the combined application of shear and direct compression, comprising the steps of:

(a) forcing a charge of granular solids to flow through a tapered converging passage and into a receiving chamber, whereby the granular solids are subjected to deformation in a direction perpendicular to the direction of flow, to produce in the receiving chamber a compact formed of the granular solids; and, (b) subjecting the compact formed in step (a) to direct compression parallel to the axis of flow, to produce a compressed compact.

13. A process for compacting granular solids by the combined application of shear and direct compression, comprising the steps of:

(a) forcing a charge of granular solids to flow through a tapered converging passage and into a receiving chamber, whereby the granular solids are subjected to deformation in a direction perpendicular to the direction of flow, to produce in the receiving chamber a compact formed of the granular solids; and, (b) repeating step (a) but with the compact formed in step (a) included in the charge used in step (b).

14. The process of claim 13 further comprising the step of:

(c) subjecting the compact formed in step (b) to direct compression parallel to the axis of flow, to produce a compressed compact.

* * * * *